United States Patent [19]

Hrinsin

[11] 4,284,012

[45] Aug. 18, 1981

[54] RAILWAY TANK CAR CRADLE SUPPORT

[75] Inventor: John A. Hrinsin, St. Louis, Mo.

[73] Assignee: ACF Industries, Inc., New York, N.Y.

[21] Appl. No.: 44,783

[22] Filed: May 31, 1979

[51] Int. Cl.[3] ..... B61D 5/06; B61F 1/00; B61F 1/14

[52] U.S. Cl. ..... 105/362; 105/228; 105/360

[58] Field of Search ..... 105/358, 360, 362, 228

[56] References Cited

U.S. PATENT DOCUMENTS

| | | | |
|---|---|---|---|
| 781,030 | 1/1905 | Sturdevant | 105/362 |
| 797,334 | 8/1905 | Sturdevant | 105/362 |
| 1,875,609 | 9/1932 | Isaacson | 105/360 |
| 3,336,879 | 8/1967 | Halcomb | 105/360 X |
| 3,631,815 | 1/1972 | Heap et al. | 105/358 |

*Primary Examiner*—John P. Silverstrim
*Assistant Examiner*—Howard Beltran
*Attorney, Agent, or Firm*—Henry W. Cummings

[57] ABSTRACT

A tank car stub sill support structure is provided in which a half ring is attached to the inner end of a stub center sill at each end of the car. The half ring includes a top cover plate which engages the lower half of the tank, and a lower cover plate which is vertically spaced below the top cover plate. A vertical web joins the top cover plate and the bottom cover plate. The height of the vertical web and the distance between the top cover plate and the bottom cover plate varies in accordance with the bending moment applied to the ring by the tank and lading in the car. Thus the height of the vertical web is maximum at the centerline of the car and decreases to a minimum at the sides of the car. The stub sill is welded to the upper cover plate, bottom cover plate and to the vertical web on the outboard side of the vertical web. The coupler impact loads are thus transmitted into the upper cover plate and into the tank substantially entirely in shear. Applying the coupler impact loads to the tank shell in shear is a desirable way of dissipating the impact load into the tank shell, and prevents distortion and deformation of the circular cross section of the tank shell, thus making the shell more resistant to buckling.

7 Claims, 6 Drawing Figures

RAILWAY TANK CAR CRADLE SUPPORT

BACKGROUND OF THE INVENTION

In U.S. Pat. No. 3,336,879 a tank support arrangement for a railway tank car is disclosed in which a pair of circular rings attached to the inner ends of tank car stub sills located at opposite ends of the car engage and support the tank. A cradle pad or saddle plate welded to the stub sill supports the tank outboard of the circular rings. This arrangement is desirable since the rings provide a large surface area in which to dissipate coupler impact loads into the tank shell. However, these rings add considerable weight to the car. The saddle plate also adds weight to the car.

SUMMARY OF THE INVENTION

The object of the present invention is to provide a tank support arrangement which utilizes the feature of large surface area to dissipate coupler loads and thus adds less weight to the car.

In accordance with the present invention, a tank car stub sill support structure is provided in which a half ring is attached to the inner end of a stub center sill at each end of the car. The half ring includes a top cover plate which engages the lower half of the tank, and a lower cover plate which is vertically spaced below the top cover plate. A vertical web joins the top cover plate and the bottom cover plate. The height of the vertical web and the distance between the top cover plate and the bottom cover plate varies in accordance with the bending moment applied to the ring by the tank and lading in the car. Thus the height of the vertical web and the distance between the top cover plate and the bottom cover plate is maximum at the centerline of the car and decreases to a minimum at the sides of the car.

The stub sill is welded to the upper cover plate, bottom cover plate and to the vertical web on the outboard side of the vertical web. The coupler impact loads are thus transmitted into the upper cover plate and into the tank substantially entirely in shear. The top cover plate and the vertical web may be provided with cut out portions adapted to receive heater coils.

The stub sill preferably comprises a pair of vertical legs each having an outwardly extending horizontal flange. In the outer end portion of the stub sill a curved plate joins the top of the vertical legs. A bottom plate holds in place a conventional coupler and a conventional draft gear. Inboard of the draft gear, a conventional center filler including a center pin is welded to the vertical legs, and a curved center filler plate is welded to the top of the vertical legs above the center filler. A body bolster extends outwardly on either side of the stub sill including a bolster top cover plate which is welded to opposite edges of the curved center filler plate. The vertical legs extend outboard of the bolster and are welded to the ring.

Thus with this arrangement the upper portion of the rings utilized in U.S. Pat. No. 3,336,879 is not needed which reduces weight. In addition, the cradle pad used in U.S. Pat. No. 3,336,879 may be eliminated to save additional weight.

Applying the coupler impact loads to the tank shell in shear is a desirable way of dissipating the impact load into the tank shell. The vertical webs effectively react the moment caused by the tank body and the lading. The circular cross section of the tank shell is thus restrained from distortion and deformation making the tank shell more resistant to buckling.

THE DRAWINGS

DESCRIPTION OF PREFERRED EMBODIMENTS

Figure 1:
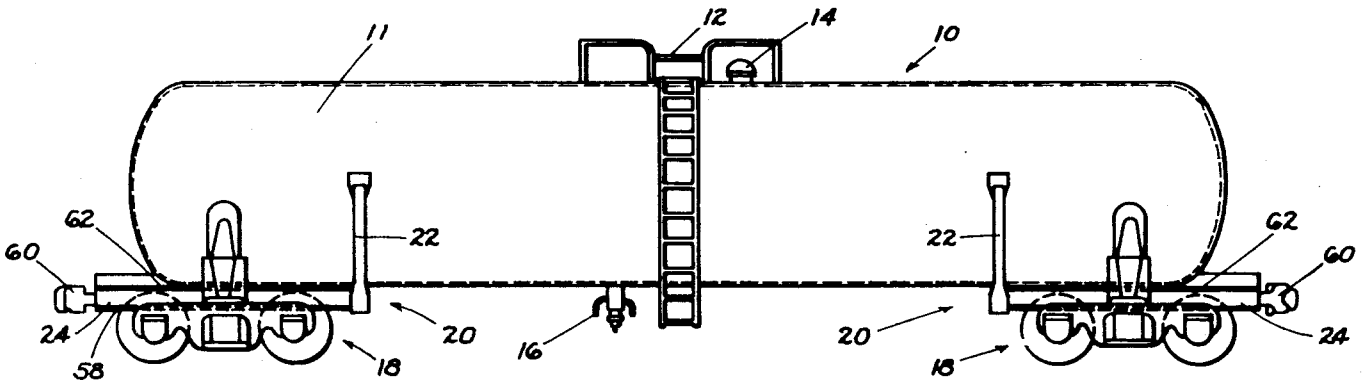
FIG. 1 is a side elevation view of a railway tank car constructed according to the present invention.
Figure 5:
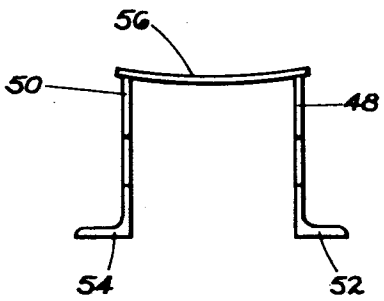
FIG. 5 is an end view of a stub sill which may be used in the present invention.
Figure 6:
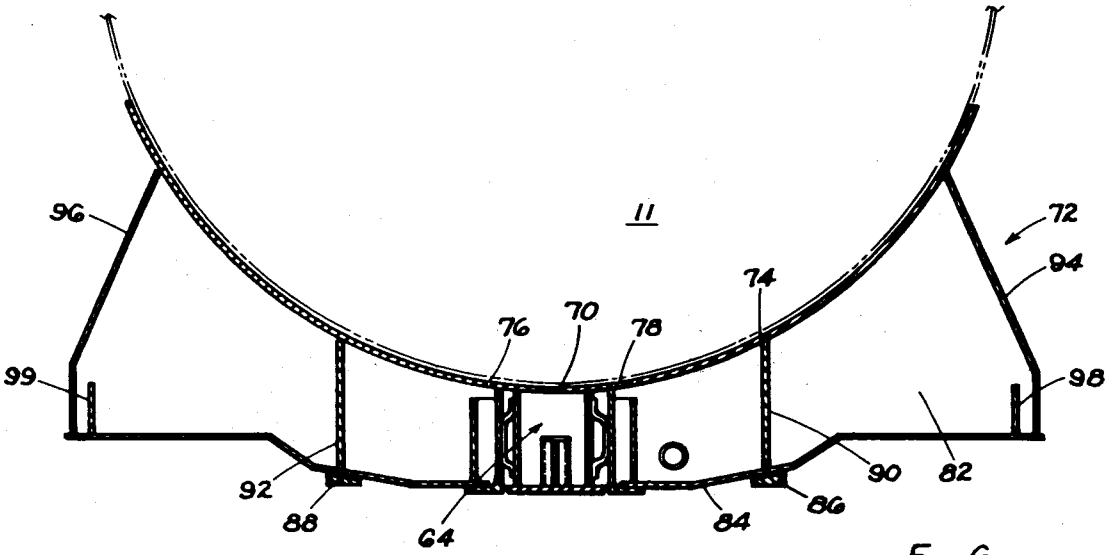
FIG. 6 is a sectional view looking in the direction of the arrows along the line 6—6 in FIG. 4.

A railway tank car 10 includes a tank 11, a dome 12, a safety valve 14 and a lading valve 16. The lading may be loaded through the dome 12 or through the lading valve 16, as is known in the art. The car is supported at opposite ends by trucks 18.

The present invention is concerned with the tank car support structure 20, one of which is located at each end of the car. Since the construction of each underframe structure 20 is the same, only one end will be described.

In accordance with the present invention, the tank car support structure 20 is provided in which a half ring 22 is attached to the inner end of a stub center sill 24 at each end of the car. The half ring includes a top cover plate 26 which engages the lower half of the tank 11, and a lower cover plate 28 which is vertically spaced below the top cover plate. A vertical web 30 joins the top cover plate and the bottom cover plate. The height of the vertical web and the distance between the top cover plate and the bottom cover plate varies in accordance with the bending moment applied to the ring by the tank 11 and lading in the car. Thus the height of the vertical web and the distance between the top cover plate and the bottom cover plate is maximum at the centerline 32 of the car and decreases to a minimum at the sides of the car 34 and 36. The upper ends 38 and 40 of the bottom cover plate abut and are welded to top cover plate 26.

The stub sill 24 is welded to the upper cover plate 26, bottom cover plate 28 and to vertical web 30 on the outboard side 42 of the vertical web. The coupler impact loads are thus transmitted into the upper cover plate 26 and into the tank substantially entirely in shear. The large surface area of the half ring thus applies the load to the tank shell substantially entirely in shear.

Figure 3:
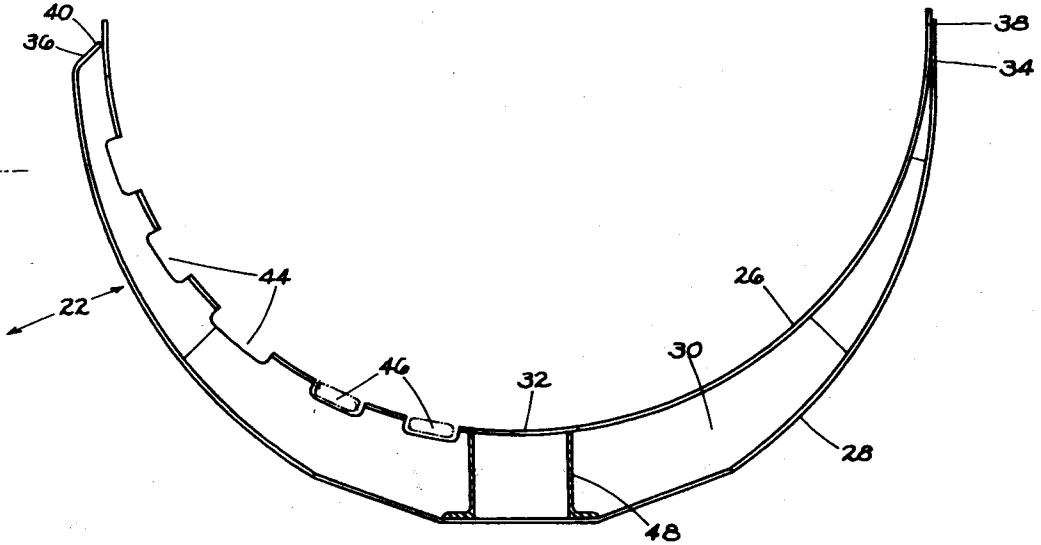
FIG. 3 is a side elevation view of the stub sill underframe and half ring of the present invention looking in the direction of the arrows along the line 3—3 in FIG. 4.
Figure 2:
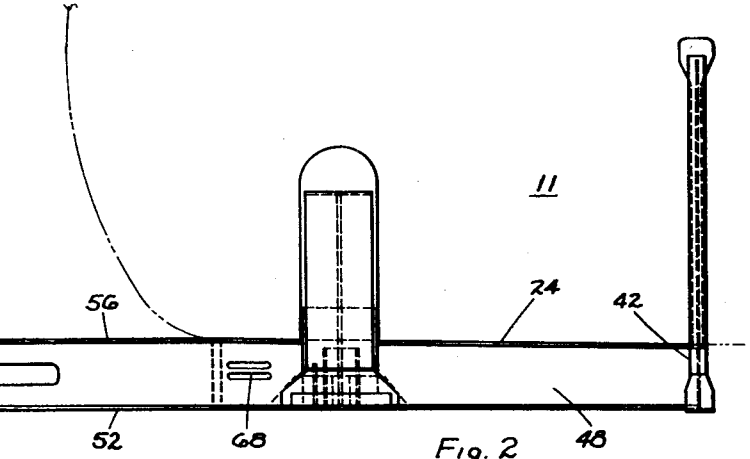
FIG. 2 is a side view with the coupler and draft gear removed illustrating the stub sill underframe and half ring of the present invention.
Figure 4:
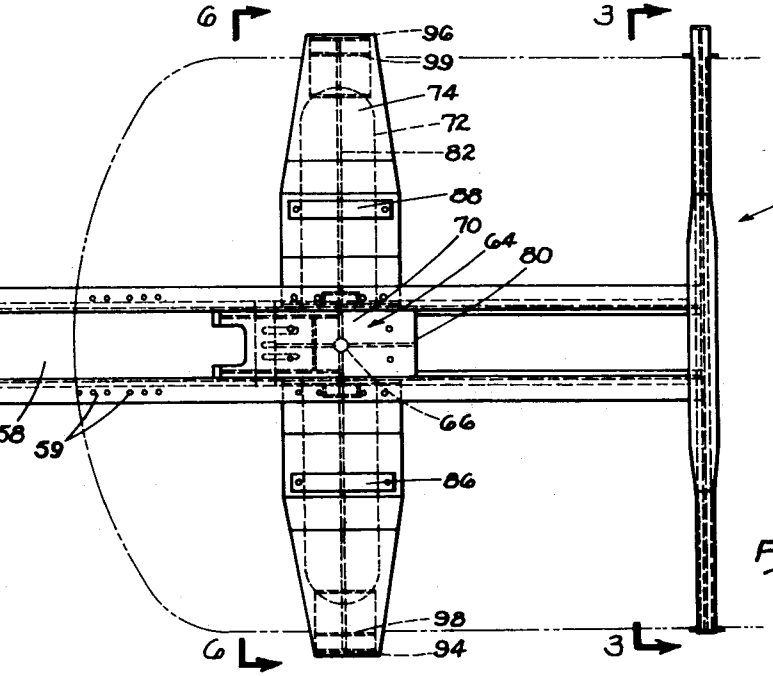
FIG. 4 is a bottom view of the stub sill underframe of the present invention with the coupler and draft gear removed.

The top cover plate and the vertical web may be provided with optional cut out portions 44, a half section of which is shown in FIG. 3, adapted to receive heater coils 46.

The stub sill 24 preferably comprises a pair of vertical legs 48 and 50 each having an outwardly extending horizontal flange 52 and 54. In the outer end portion of the stub sill a curved plate 56 joins the top of the vertical legs. A bottom plate 58 held in place with fasteners 59 holds in place a conventional coupler 60 and a conventional draft gear 62. Inboard of the draft gear a conventional center filler 64 including a center pin 66 is welded to the vertical legs at 68 and a curved center filler plate 70 is welded to the top of the vertical legs 48 and 50 above the center filler. A body bolster 72 extends outwardly on either side of the stub sill including a bolster top cover plate 74 which is welded to opposite edges 76 and 78 of the curved center filler plate. The vertical legs 48 and 50 extend outboard of the bolster and are welded to the ring. The center filler plate 70 terminates at 80.

The body bolster 72 further includes a vertical web 82, a lower cover plate 84 having attached thereto side bearings 86 and 88. Side bearing supports 90 and 92 extend vertically above side bearings 86 and 88 and are welded to vertical web 82. Bolster cap plate 94 and 96 extend vertically upwardly from bottom cover plate 84 and inwardly, and engage top cover plate 74. Vertical gussets 98 and 99 also reinforce the bottom cover plate 84 at the sides.

Thus, with this arrangement the upper portion of the rings utilized in U.S. Pat. No. 3,336,879 is not needed, which reduces weight. In addition, the cradle pad used in U.S. Pat. No. 3,336,879 may be eliminated to save additional weight.

Applying the coupler impact loads to the tank shell in shear is a desirable way of dissipating the impact load into the tank shell. The bending moment load of the tank and the lading is reacted by vertical web 30 and the stub sills 20 into the trucks 14.

What is claimed is:

1. A tank car stub sill support structure comprising: a stub center sill located at each end of the car and extending inboard of a body bolster extending transversely of the car and engaging said stub sill; coupler means located within each stub sill; a half ring attached to each said stub center sill at its inner end, each said half ring including a curved top cover plate which engages the lower portion of the tank, and a curved lower cover plate vertically spaced below the top cover plate; a vertical web joining the top cover plate and the bottom cover plate; said stub sill engaging said top cover plate, said bottom cover plate and said vertical web; the height of the vertical web and the distance between the top cover plate and the bottom cover plate varying in a substantially continuous decreasing manner from said stub sill to the area of intersection of said plates in accordance with the bending moment applied to the ring by the tank and lading in the car; said stub sill connected only to said body bolster and said half ring whereby coupler impact loads are transmitted into said stub sill and from said stub center sill into said body bolster and into said ring and into the upper cover plate and into the tank substantially entirely in shear.

2. A tank car stub sill support structure according to claim 1 wherein said stub sill is welded to the upper cover plate, bottom cover plate and to the vertical web on the outboard side of the vertical web.

3. A tank car stub sill support structure according to claim 1 wherein said top cover plate and said vertical web are provided with cut out portions adapted to receive heater coils.

4. A tank car stub sill support structure according to claim 1 wherein the stub sill comprises a pair of vertical legs, each having an outwardly extending horizontal flange.

5. A tank car stub sill support structure according to claim 4 wherein said vertical legs extend outboard of the bolster and are welded to said ring.

6. A tank car stub sill support structure according to claim 4 wherein in the outer end portion of the stub sill a curved plate joins the top of the vertical legs.

7. A tank car stub sill support structure according to claim 6 wherein a center filler is welded to the vertical legs, and a curved center filler plate is welded to the top of the vertical legs above the center filler, and a body bolster extends outwardly on either side of the stub sill including a bolster top cover plate which is welded to opposite edges of the curved center filler plate.

* * * * *